US008308846B2

(12) United States Patent
Op de Laak et al.

(10) Patent No.: US 8,308,846 B2
(45) Date of Patent: Nov. 13, 2012

(54) METHOD AND DEVICE FOR PRECIPITATING IMPURITIES FROM A STREAM OF GAS

(75) Inventors: Marcel Op de Laak, Freiburg (DE); Franz Knopf, Buehl (DE)

(73) Assignee: WOCO Industrietechnik GmbH, Bad Soden-Salmuenster (DE)

( * ) Notice: Subject to any disclaimer, the term of this patent is extended or adjusted under 35 U.S.C. 154(b) by 380 days.

(21) Appl. No.: 12/602,475

(22) PCT Filed: May 10, 2008

(86) PCT No.: PCT/EP2008/003798
§ 371 (c)(1),
(2), (4) Date: Jun. 3, 2010

(87) PCT Pub. No.: WO2008/145251
PCT Pub. Date: Dec. 4, 2008

(65) Prior Publication Data

US 2010/0294129 A1 Nov. 25, 2010

(30) Foreign Application Priority Data

May 31, 2007 (DE) ..... 10 2007 025 416

(51) Int. Cl.
*B03C 3/68* (2006.01)

(52) U.S. Cl. ..... 95/5; 60/275; 95/69; 95/78; 96/20; 96/57; 96/61; 96/97

(58) Field of Classification Search ..... 95/2, 5, 95/69, 78; 96/18, 20, 21, 55, 57, 60, 61, 96/97; 60/275, 311; 323/903
See application file for complete search history.

(56) References Cited

U.S. PATENT DOCUMENTS 2,195,431 A * 4/1940 Shively et al. ..... 422/186.04
(Continued)

FOREIGN PATENT DOCUMENTS

EP 1 277 928 A1 1/2003
(Continued)

OTHER PUBLICATIONS

International Search Report mailed Oct. 9, 2008, in corresponding Application Na PCTIEP2008/003798, mailed May 10, 2008, 3 pages.

*Primary Examiner* — Richard L Chiesa
(74) *Attorney, Agent, or Firm* — Christensen O'Connor Johnson Kindness PLLC

(57) ABSTRACT

Liquid and/or particle-shaped impurities are precipitated from a stream of gas, for example, from a stream of gas that originates from a crankcase of an internal combustion engine and is directed to the engine's intake side. The stream of gas is passed through a gas discharge section between two electrodes. The stream of gas is passed between an emission electrode which is formed by electrode tips and an opposing electrode at a distance therefrom. A direct voltage which exceeds the breakdown voltage is applied to the electrodes using a direct current high voltage source, and the current which occurs over the gas discharge section between the electrodes is limited. A stable low energy direct current plasma is formed in the space between the two electrodes. The impurities are electrically charged and attracted to the opposing electrode by means of electrical field forces.

16 Claims, 3 Drawing Sheets

U.S. PATENT DOCUMENTS

| | | | | |
|---|---|---|---|---|
| 3,648,437 | A * | 3/1972 | Bridges | 96/20 |
| 4,138,233 | A | 2/1979 | Masuda | |
| 4,152,124 | A * | 5/1979 | Davis | 96/21 |
| 5,476,539 | A * | 12/1995 | Suzuki et al. | 96/44 |
| 6,186,128 | B1 | 2/2001 | Diotte | |
| 7,267,711 | B2 * | 9/2007 | Liu | 96/21 |
| 7,547,353 | B2 * | 6/2009 | Reyes et al. | 96/80 |
| 7,601,205 | B2 * | 10/2009 | Furukawa et al. | 96/69 |
| 7,651,553 | B2 * | 1/2010 | Pletcher et al. | 96/83 |
| 7,753,994 | B2 * | 7/2010 | Motegi et al. | 96/80 |
| 7,785,404 | B2 * | 8/2010 | Leng et al. | 96/21 |
| 2006/0278082 | A1 * | 12/2006 | Tomimatsu et al. | 96/66 |
| 2008/0202331 | A1 * | 8/2008 | Abdelkrim et al. | 95/5 |

FOREIGN PATENT DOCUMENTS

| | | | |
|---|---|---|---|
| GB | 1 451 222 | | 9/1976 |
| JP | 5-154409 | A * | 6/1993 |
| WO | 99/25972 | A1 | 5/1999 |
| WO | 00/69537 | A2 | 11/2000 |
| WO | 01/92694 | A1 | 12/2001 |
| WO | 2005/049215 | A1 | 6/2005 |
| WO | 2005/119020 | A1 | 12/2005 |
| WO | 2006/128711 | A1 | 12/2006 |

* cited by examiner

METHOD AND DEVICE FOR PRECIPITATING IMPURITIES FROM A STREAM OF GAS

FIELD OF DISCLOSURE AND INTRODUCTION

The present disclosure relates to a method for precipitating liquid and/or particle-shaped impurities from a stream of gas, for example, for precipitating oil droplets, soot particles, and/or dust from a stream of blow-by gas that originates from a crankcase of an internal combustion engine and is directed to the intake side of the internal combustion engine. In this context, the stream of gas that is to be cleaned is passed through a gas discharge section between at least two electrodes, of which at least one electrode is an active or emission electrode (cathode) and at least one other electrode is a precipitation or counter-electrode (anode), by means of which the impurities to be precipitated from the stream of gas are electrically charged and sucked in or attracted by the counter-electrode by means of electrical field forces.

The present disclosure further relates to a device for precipitating liquid and/or particle-shaped impurities from a stream of gas, for example, for precipitating oil droplets, soot particles, and/or dust from a stream of blow-by gas that originates from the crankcase of an internal combustion engine and is directed to the intake side of the internal combustion engine. The device includes at least two electrodes that are set apart from each other and between which the flow path of the gas stream runs. One of the electrodes is an active or emission electrode (cathode) and the other electrode is a precipitation or counter-electrode (anode), by means of which the impurities present in the stream of gas can be electrically charged and can be sucked in or attracted by the counter-electrode by means of electrical field forces.

BACKGROUND

A comparable method and a comparable device for cleaning crankcase ventilation gases are known from MTZ Motortechnische Zeitschrift 60 (1999) 7/8. In this case, there is a central wire electrode that is operated with a voltage below the breakdown voltage and which is encircled at a distance by a coaxial counter-electrode as the anode, so that the gas stream to be cleaned can flow through this tubular counter-electrode.

In view of the flow rate of the gas to be cleaned, this device is not suitable for effective cleaning because of its limited length. In addition, there is a considerable risk of fouling the wire electrode, which may result in the device operating in a non-homogeneous way and thus ineffectively.

In addition, particle separators, which precipitate charged particles from a gas stream at a flat electrode by means of electrical field forces, exist in a variety of embodiments, for example, as an electrostatic dust filter or as a so-called oil separator for cleaning crankcase ventilation gases. These embodiments all share a common feature that the electrical field is generated with as high an electrical field strength as possible, although the electrical voltages have to be significantly below the breakdown voltage for the electrode gap of such electronically operated separators. Usually, the operating voltage is less than half the breakdown voltage, in order to avoid uncontrolled local discharges (electrical voltage breakdown).

The result is low efficiency and a long path is required for the actual separation, especially if the flow rate of the gas conveying the particles is high.

In addition, large scale treatments of exhaust gas for clean air can be carried out with plasma technology. In this case, a plasma technology with pulsed electric filters is used, where the pulse exhibits peak power of 50 megawatts at pulse rates of 200 hertz. The plasmas in these particle filters are superposed with high voltage pulses. Such a device is expedient only in connection with large scale industrial plants.

BRIEF SUMMARY AND INITIAL DESCRIPTION

Therefore, an object is to provide a method and a device of the genre described in the introductory part, with which effective cleaning of a gas stream is possible even under restricted space conditions, even if this gas stream exhibits a high flow rate.

For achieving this object, a gas stream is passed between at least one electrode tip, which serves as an emission electrode (cathode), and a counter-electrode (anode), which is positioned at a distance from said emission electrode. A direct voltage, exceeding the breakdown voltage, is applied to the electrodes. The current of the gas discharge section that establishes itself between the two electrodes is limited, by means of which a stable low energy plasma is formed in the space between the two electrodes.

In this way, a direct current plasma of the "non-equilibrium plasma under atmospheric pressure" type can be generated between the electrodes in the gas stream or flow channel of the gas to be cleaned. The result is a direct current plasma having a high electron density, but a comparatively low temperature, so that gas that is directed through this plasma, and in particular its impurities, very quickly assume a high charge and can be attracted correspondingly fast by the counter-electrode so that, given a low space requirement, an effective precipitation of the impurities from a gas stream is possible, even if this gas stream exhibits a high flow rate.

Owing to the negative current-voltage characteristic of such a plasma, the current that establishes itself between the electrodes is limited. The present disclosure makes use of the fact that in the case of such a direct current plasma, the ions and the neutral gas particles exhibit a significantly lower temperature of, for example, less than 100° C., and that the number of negative electrons and the number of positive gas ions of the gas bearing the impurities to be precipitated are not in a state of equilibrium.

In this case, it is practical to apply to the electrodes a voltage that is at least 1.2 times or one and one-half times the breakdown voltage. Therefore, in order to generate the direct current plasma, a high electric voltage, which significantly exceeds the breakdown voltage, is used. A non-equilibrium plasma of high electron density is generated in the space between the electrodes. In this space, even large particles to be precipitated can be electrically charged to the maximum degree, in order to precipitate at the counter-electrode by the shortest route.

The limited current between the electrodes can expediently be selected in proportion to the flow rate and can be increased at a higher flow rate, a feature that results in the highest possible efficiency, so that the implementation of the method has a space requirement that is kept as low as possible.

The method becomes especially effective and efficient if the gas stream is directed past a plurality of electrode tips, which form the active (or the emission) electrode. In the event that the active electrode exhibits an adequately high density of electrode tips, the limit charge of the polluting particles in the gas stream can be reached as a function of the configuration of these tips. In particular, with the use of a tip array as the active electrode, a very effective cleaning can be achieved by the shortest route, thus, in a space saving manner, even if the gas to be cleaned exhibits a high flow rate.

The present disclosure provides a device with which, even under restricted space conditions, an effective cleaning of a gas stream is possible, even if this gas stream exhibits a high flow rate. For example, a device of the type described in the introductory part may be provided in which the precipitation electrode or counter-electrode (anode) is provided in a flat form and is combined with an active electrode (cathode) that is positioned at a distance from said counter-electrode and which exhibits at least one tip that is aimed in the direction of the flat electrode. In order to limit the current, a current limiting element is provided on the current supply path to this tip that forms the active electrode.

With such a device, it is possible to generate an equilibrium plasma having an electron density of about $10^{10}$ electrons per cubic centimeter and electron temperatures of up to 50,000° C. between the electrodes in the flow channel of the gas to be cleaned. However, at the same time, the ions and the neutral gas particles exhibit a significantly lower temperature of less than 100° C. and the number of negative electrons and the number of positive gas ions of the gas bearing the particles to be precipitated are not in a state of equilibrium. In this way, an effective precipitation of impurities at the flat electrode can be achieved by a relatively short route.

The current limiting element at the active electrode designed as a tip can be a resistor or a semiconductor. This approach constitutes a simple arrangement of high effectiveness.

It is especially advantageous if the active electrode or the emission electrode (cathode) is formed by a plurality of tips. Correspondingly large is the field volume, in which the direct current plasma is formed, so that the particles to be precipitated are charged by the shortest route and can precipitate at the flat counter-electrode.

In one embodiment of the device according to the invention, the tips forming the emission electrode (cathode) are arranged in several rows, which are situated one after the other in the direction of flow of the gas to be cleaned. The tips of each row are offset, preferably laterally, in relation to the tips of the next row. As a result, there is an overlapping of the direct current plasma in the direction of flow, a state that in turn results in the space between the electrodes being practically filled with this direct current plasma, thus preventing any gaps from remaining open in the direction of flow.

Therefore, the emission electrode can be designed expediently as an emission tip array and can appear as a grid, which eliminates gaps in the plasma formed between the electrodes for a selected flow cross section of the gas stream in the direction of motion of the particles. The respective next row of tips is arranged so as to be offset by a fraction of the basic grid width. When there is an adequate number of such rows of tips that are arranged one after the other in the direction of flow, the result is a desired closed plasma arrangement in the direction of flow so that the targeted cleaning can take place by a relatively short route even in the case of a high flow rate.

It is advantageous if, in at least one embodiment of the device according to the invention, in use, a direct voltage that is higher than the breakdown voltage is applied between the electrodes and, if a device for current limiting is provided at the active electrode(s).

In this way, it is possible to attach each of the tips of the emission electrode by means of a plasma current limiting element, for example, a high impedance resistor, to a preferably negative direct current high voltage source of which the operating voltage exceeds the breakdown voltage to the conductive counter-electrode, which is configured in a flat form opposite the tip array. As a result, a non-equilibrium plasma having an electron density of about $10^{10}$ $cm^{-3}$ is generated in the space between each tip of the tip array and the flat counter-electrode connected to the positive pole of the direct voltage source, in which space also the largest particles to be precipitated are electrically charged to the maximum amount and precipitate on the opposite flat counter-electrode by the shortest route.

At the same time, it is advantageous for precipitating the impurities as uniformly and effectively as possible, if the tips forming the active electrode are arranged in a plane and if the counter-electrode is designed so as to be planar and flat and is arranged parallel to the plane, in which the tips of the active electrode are arranged. In this way, all of the tips of the active electrode exhibit identical spacing, with virtually constant conditions regarding the direct current plasma that is formed resulting in the whole device.

The device may include a housing on the floor of which the counter-electrode lies flat, and, at a distance thereto, tips forming the active electrode can be provided between side walls of the housing. The housing has an inlet and an outlet for the gas stream. This constitutes an arrangement that is especially practical from a design point of view for arranging and housing the electrodes in a practical way and to pass the gas stream between them.

In another practical embodiment of the invention for even better precipitation or cleaning results, the device includes a mechanical separator, in particular, for relatively large droplets or particles, upstream of the electrodes in the direction of flow. Thus, prior to the precipitation between the electrodes, larger particles can already be precipitated mechanically so that they no longer strain the electronic precipitation. With this arrangement, the entire system can operate with correspondingly less electrical energy. This approach may above all be advantageous in non-stationary systems, for example, in the engines of vehicles.

For example, it is possible that the mechanical separator be designed as an impingement separator with at least one baffle or that said mechanical separator is a cyclone separator. Such mechanical separators are known per se and can be selected and adapted in a practical way for the intended application.

An aperture or bore for a return of precipitated oil or for removing the precipitated particles can be provided between the mechanical separator and the electrode separator. As a result, if cleaning is necessary, it may be done at longer time intervals than if the precipitated oil droplets and particles were to be evacuated only by means of cleaning processes.

An additional embodiment of the device, according to the invention, can provide that emission electrodes designed as tips are arranged on both sides of a flat or plate-shaped counter-electrode. In this way, an effective precipitation of impurities or particles from a gas stream can be achieved in an even narrower space.

Since the polluting particles can assume a high charge, both such a configuration with emission electrodes arranged on both sides of a plate-shaped counter-electrode and also a configuration with emission electrodes designed as tips on just one side of a flat plate-shaped counter-electrode, can be carried out in such a space-saving way that the entire device can be incorporated or installed, for example, into the cylinder head covers or intake pipes of internal combustion engines or also into other modules and components that are in communication with a stream of gas that is to be cleaned.

In particular, when individual or multiple features and measures described above are combined, the result is a method and a device for precipitating impurities from a stream of gas with which the avoidance of uncontrolled local discharges does not have to be at the expense of poor efficiency and a very long path length for the actual precipitation, but rather a high efficiency can be achieved by means of a direct current plasma of the "non-equilibrium plasma under atmospheric pressure" type, even if very little space in the direction of flow is available. In this context, the flow channel can have preferably a rectangular cross section, wherein this rectangular cross section can be defined by the two electrodes on two opposite sides.

BRIEF DESCRIPTION OF THE DRAWINGS

Embodiments of the invention are described in detail below with reference to the drawings in which.

DETAILED DESCRIPTION

Figure 1:
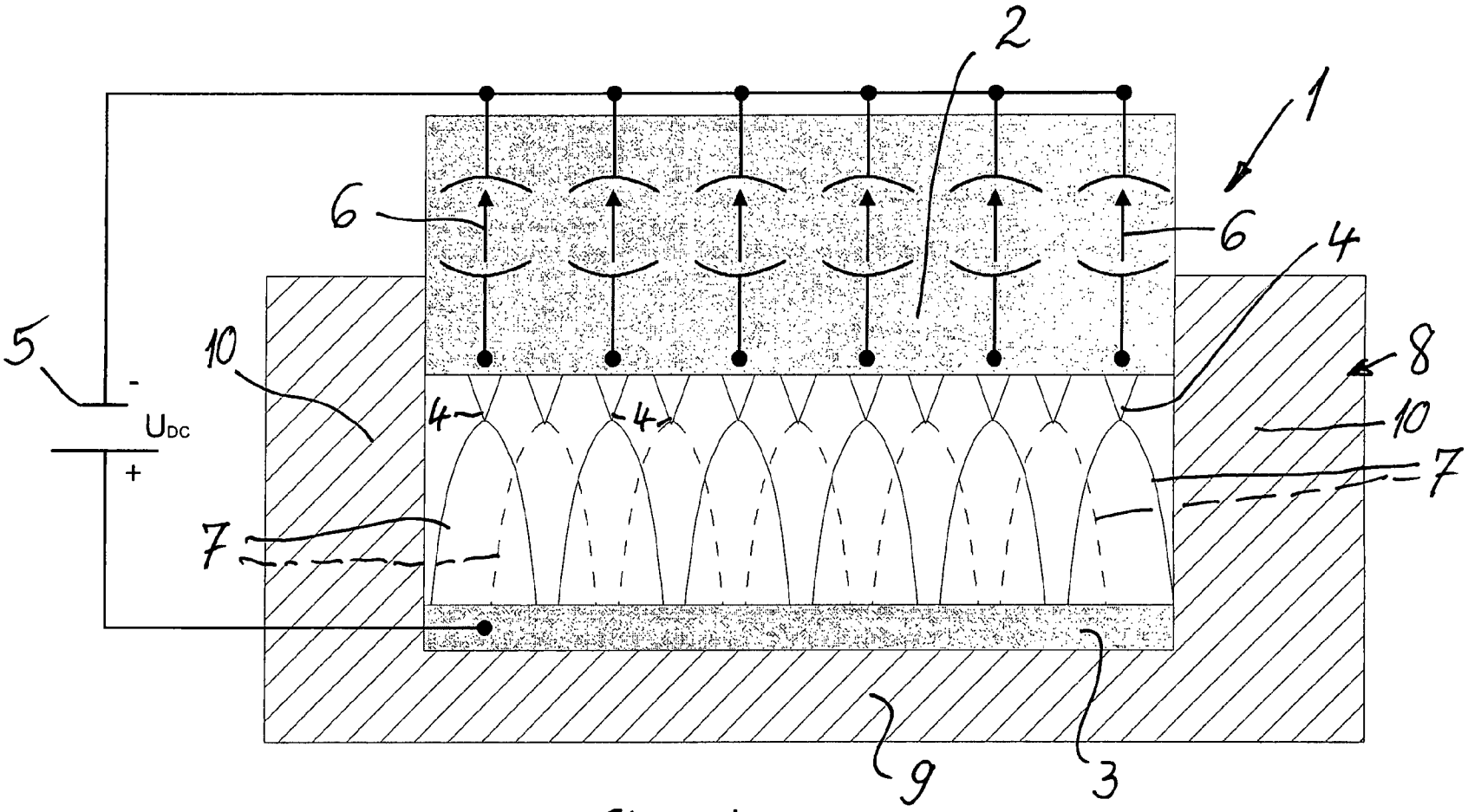
FIG. 1 depicts a cross section of a housing with a device as described herein comprising emission electrodes, formed by tips, and a plate-shaped, flat counter-electrode, when viewed in the direction of the stream of gas glowing between these electrodes.

In the following description of the embodiments, those parts that exhibit identical functions have identical reference numerals, even if the shape of these parts is somewhat different.

Figure 2:
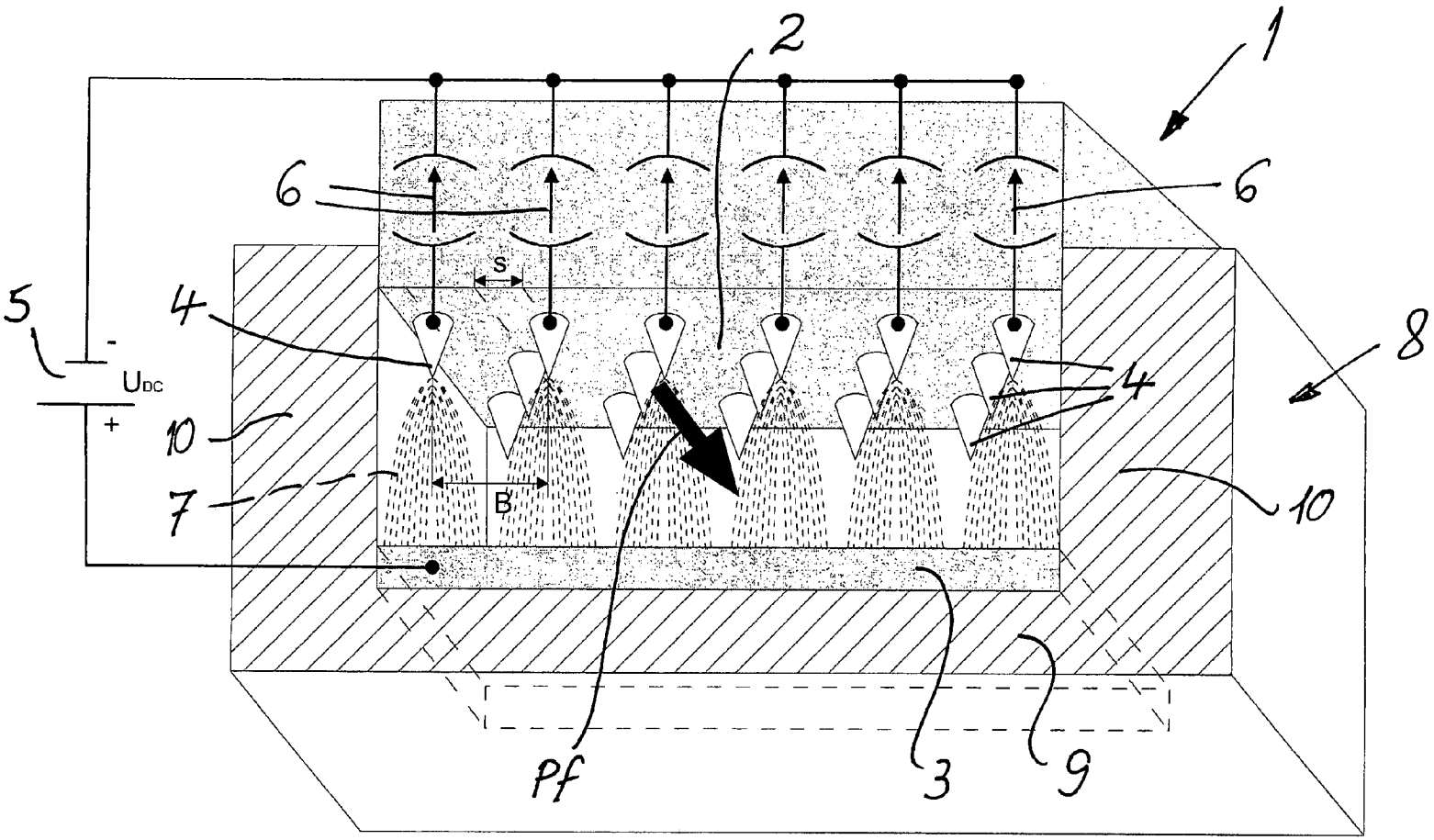
FIG. 2 is a perspective view corresponding approximately to FIG. 1, with three successive rows of electrodes formed by the tips.
Figure 3:
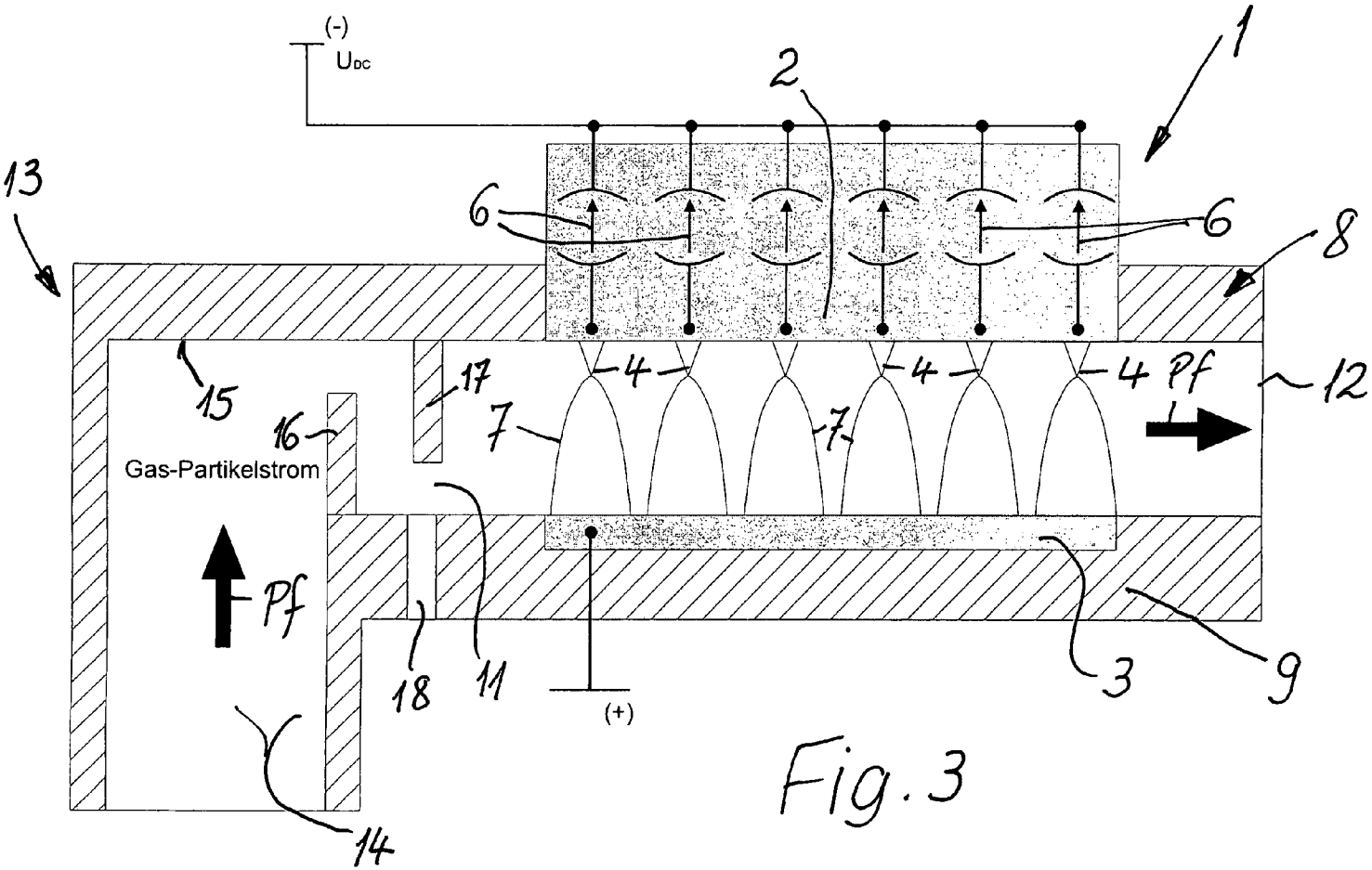
FIG. 3 is a longitudinal cross section of a housing containing an embodiment of a device according to the invention, wherein six rows of tips, arranged side by side, are arranged one after the other in the direction of flow and yield the tip array forming the emission electrode.

A device, which is labeled with the reference numeral 1 in all three figures, serves for precipitating liquid and/or particle-shaped impurities from a stream of gas, which is indicated by the arrow Pf in FIGS. 2 and 3. In at least one particular embodiment, the precipitation of oil droplets, soot particles, and/or dust, for example, from a stream of gas, which originates from the crankcase of an internal combustion engine and which is directed to the intake side of the internal combustion engine is concerned.

To this end, the device 1 exhibits two electrodes which are spaced apart from each other, in all of the embodiments between which the flow path of the gas stream Pf runs, wherein one of the electrodes is an active or emission electrode 2 or cathode and the other electrode is a precipitation or counter-electrode 3 or anode with which the impurities in the stream of gas Pf can be electrically charged and can be sucked in or attracted by the counter-electrode 3 by means of electrical field forces.

Furthermore, it is clear in all three figures that the precipitation electrode or counter-electrode 3 is designed so as to be flat and plate-shaped and planar, and that this counter-electrode 3 is combined with a spaced-apart active or emission electrode 2, which is formed by a plurality of tips 4 that are aimed at the flat electrode 3 and are arranged in a common plane, which runs parallel to the counter-electrode 3 at a distance from it so that the flow path for the gas stream Pf between these electrodes 2 and 3 is limited on two sides.

In this case, FIGS. 1 and 2 show a direct current high voltage source 5, the negative pole of which is connected to the emission electrode 2 formed by the tips 4, and the positive pole of which is connected to the flat counter-electrode 3. In order to be able to apply a direct voltage that exceeds the breakdown voltage so that a direct current plasma is formed, the current is limited at the active or emission electrode 2 with the aid of current limiting elements 6, which are arranged in each of the conductors that run to one of the tips 4. These current limiting elements 6 can be either a high impedance resistor or a semiconductor or also any other current limiting component that is known per se.

In particular, when all three figures are viewed simultaneously, it becomes clear that the tips 4 forming the emission electrode 2 or cathode can be arranged in multiple rows located one after the other in the direction of flow, wherein the tips 4 of one row are offset laterally in relation to the tips of the next row.

FIG. 1 shows an arrangement with two rows of tips, wherein the tips 4 of the second row are arranged, when viewed in the direction of flow, in the respective gap between two tips of a first row that is located in front, so that the plasma cones 7 starting from these tips 4 and extending to the counter-electrode 3 overlap (when viewed in the direction of flow) transversely to the flow, so that no gap in the direction of flow remains open for the gas stream at least below the tips 4.

The aforesaid applies all the more to the arrangement in FIG. 2, where three rows of tips 4 are located one after the other in the direction of flow, wherein, for the sake of clarity, not all of the plasma cones 7 are shown.

In FIG. 3, an arrangement with six rows of tips 4 in total are shown, but in contrast to the views of FIGS. 1 and 2, the arrangement is rotated by 90 degrees, so that of each row of tips 4, only one of these tips 4 is visible.

Thus, in all of the embodiments depicted in the figures, the emission electrode 2 is designed as an emission tip array and appears as a grid. For a selected flow cross section, the emission tip array has a rectangular cross section in the embodiments. This prevents gaps in the plasma 7 formed between the electrodes 2 and 3 for the gas stream in the direction of motion of the particles by means of the above described overlapping of the plasma cones, because the respective next row of tips 4 is arranged so as to be offset by a fraction of the basic grid width.

In all three embodiments the device 1 has a housing 8, on the floor 9 of which the counter-electrode 3 lies flat on the inside. Positioned at a distance from said counter-electrode 3, the tips 4 forming the active electrode 2 are provided between the side walls 10 of this housing 8. The housing 8 has an inlet 11 and an outlet 12 for the stream of gas Pf. The inlet 11 and the outlet 12 are not shown in FIGS. 1 and 2, but are arranged in a manner analogous to that in FIG. 3. In this case, the housing cross section forming the flow cross section is rectangular.

FIG. 3 shows an embodiment in which a mechanical separator which are marked with the reference numeral 13. The mechanical separator 13 is intended, in particular, for relatively large droplets or particles and is arranged, as an additional design, upstream of the electrodes 2 and 3 in the direction of flow. At the same time, it is apparent from FIG. 3 that this separator 13 is connected directly to the housing 8 and thus walls of the housing 8 extend up to the separator 13. In this context, this separator 13 is designed as an impingement separator, that is, a supply duct 14 for the gas stream runs first vertically to the top against an impingement surface 15 and then over a baffle plate 16 to the inlet 11 of the actual device 1. Thus, the inlet 11 is also limited by a wall section 17 to one side, so that the stream of gas particles is forced to make a number of deflections that promote the mechanical precipitation of larger oil droplets or particles.

Between the mechanical separator 13 and the electrode separator, respectively, the inlet 11, one can see a downwardly directed aperture 18 or bore, which can serve as the return of the mechanically precipitated oil.

With the above described device 1, according to FIG. 1, 2, or 3, liquid and/or particle-shaped impurities can be precipitated from a stream of gas Pf, for example, from the stream of gas, which originates from a crankcase of an internal combustion engine and which is directed to the intake side of the internal combustion engine. The stream of gas that is to be cleaned is passed through a gas discharge section between the two electrodes 2 and 3, by means of which the impurities that are to be precipitated from the stream of gas are electrically charged and sucked in or attracted by the counter-electrode 3 by means of electrical field forces. In this context, the gas stream Pf is passed between an emission electrode 2, formed by the electrode tips 4, and a counter-electrode 3, which is positioned at a distance from said emission electrode. A direct voltage, exceeding the breakdown voltage, is applied to the electrodes 2 and 3 by means of a direct current high voltage source 5. The current that establishes itself over the gas discharge section between these electrodes 2 and 3 is limited so that a stable low energy plasma, which has an efficient cleaning effect, is formed in the space between the two electrodes 2 and 3.

What is claimed is:

1. A method for precipitating liquid and/or particle-shaped impurities from a stream of gas, comprising:

passing the stream of gas through a gas discharge section between at least two electrodes, of which at least one electrode is an active or emission electrode and at least one other electrode is a precipitation or counter-electrode; and precipitating the impurities from the stream of gas by electrically charging the impurities in the stream of gas in the gas discharge section and attracting the impurities to the counter-electrode by means of electrical field forces, wherein the stream of gas is passed between at least one electrode tip, which serves as the emission electrode, and a counter-electrode, which is positioned at a distance from said emission electrode, wherein a direct voltage, exceeding the breakdown voltage of the space between the at least two electrodes, is applied to the emission electrode and the counter-electrode, and wherein the current flow of the gas discharge section between the at least two electrodes is limited, by means of which a stable low energy direct current plasma is formed in the space between the at least two electrodes.

2. The method according to claim 1, wherein the direct voltage that is at least 1.2 times the breakdown voltage is applied to the at least two electrodes.

3. The method according to claim 1 further comprising selecting the limited current in proportion to the flow rate and increasing the limited current at a higher flow rate.

4. The method according to claim 1, wherein the gas stream is directed past a plurality of electrode tips that form the active or emission electrode.

5. A device for precipitating liquid and/or particle-shaped impurities from a stream of gas, comprising:

at least two electrodes that are set apart from each other and between which a flow path of the stream of gas runs, wherein one of the electrodes is an active or emission electrode and the other electrode is a precipitation or counter-electrode by means of which the impurities present in the stream of gas are electrically charged and attracted by the counter-electrode by means of electrical field forces, in particular for carrying out the method according to claim 1, wherein the precipitation electrode or counter-electrode is provided in a flat form and is combined with the active electrode that is positioned at a distance from said counter-electrode and which exhibits at least one tip that is aimed in the direction of the flat electrode, and a current limiting element that limits the current in the current supply path to the at least one tip that forms the active electrode.

6. The device according to claim 5, wherein the current limiting element at the active electrode designed as a tip is a resistor or a semiconductor.

7. The device according to claim 5 wherein the active or emission electrode is formed by a plurality of tips.

8. The device according to claim 7, wherein the tips forming the emission electrode, are arranged in several rows that are situated one after the other in the direction of flow of the stream of gas, wherein the tips of one row are offset laterally in relation to the tips of a next row of tips.

9. The device according to claim 8, wherein the emission electrode is designed as an emission tip array and the tips are arranged as a grid having a basic grid width that eliminates gaps in a plasma formed between the electrodes for a selected flow cross section of the stream of gas in the direction of motion of the gas flow, wherein a respective next row of tips is arranged so as to be offset by a fraction of the basic grid width.

10. The device according to claim 9, wherein, in use, a direct voltage that is higher than the breakdown voltage is applied between the electrodes, and a current limiting device is provided at each tip of the active electrode.

11. The device according to claim 10, wherein the tips forming the active electrode are arranged in a plane and the counter-electrode is designed so as to be planar and flat and is arranged parallel to the plane in which the tips of the active electrode are arranged.

12. The device according to claim 11, wherein the device includes a housing and the counter-electrode lies flat on a floor of said housing, wherein, positioned at a distance from said counter-electrode, the tips forming the active electrode are provided between side walls of the housing, and wherein the housing has an inlet and an outlet for the stream of gas.

13. The device according to claim 12, wherein said device further comprises a mechanical separator upstream of the electrodes in the direction of flow of the stream of gas.

14. The device according to claim 13, wherein the mechanical separator is an impingement separator with at least one baffle or a cyclone separator.

15. The device according to claim 14, further comprising an aperture or bore for a return of precipitated impurities, which is provided between the mechanical separator and the electrodes.

16. The device according to claim 15, wherein the emission electrodes designed as tips are arranged on both sides of a flat or plate-shaped counter-electrode.

* * * * *

UNITED STATES PATENT AND TRADEMARK OFFICE

CERTIFICATE OF CORRECTION

PATENT NO. : 8,308,846 B2
APPLICATION NO. : 12/602475
DATED : November 13, 2012
INVENTOR(S) : M. Op de Laak et al.

It is certified that error appears in the above-identified patent and that said Letters Patent is hereby corrected as shown below:

In the Specification

| COLUMN | LINE | ERROR |
|---|---|---|
| 8<br>Claim 5 | 5 | "field forces, in particular for" should read<br>--field forces for-- |

Signed and Sealed this
First Day of October, 2013

Teresa Stanek Rea
*Deputy Director of the United States Patent and Trademark Office*